United States Patent [19]

Hansen

[11] 4,318,672

[45] Mar. 9, 1982

[54] PARTICLE EROSION RESISTANT COVERING FOR FAN BLADE LEADING EDGE

[75] Inventor: Bent B. Hansen, Naestved, Denmark

[73] Assignee: Nordisk Ventilator Co. A/S, Naestved, Denmark

[21] Appl. No.: 958,327

[22] Filed: Nov. 6, 1978

[51] Int. Cl.[3] ..... F01D 5/28

[52] U.S. Cl. ..... 416/224; 416/229 A; 416/241 R

[58] Field of Search ..... 416/224, 229, 230, 241 R

[56] References Cited

U.S. PATENT DOCUMENTS

| | | | |
|---|---|---|---|
| 1,364,197 | 1/1921 | Heath | 416/224 |
| 2,312,219 | 2/1943 | Sensenich | 416/241 |
| 2,431,184 | 11/1947 | Martin | 416/224 |
| 3,041,040 | 6/1962 | Levinstein | 416/224 |
| 3,301,530 | 1/1967 | Lull | 416/241 |
| 3,561,886 | 2/1971 | Kreischer et al. | 416/224 |
| 3,748,110 | 7/1973 | Hodshire et al. | 416/224 |
| 4,123,595 | 10/1978 | Chang | 428/667 |

FOREIGN PATENT DOCUMENTS

| | | | |
|---|---|---|---|
| 671505 | 2/1939 | Fed. Rep. of Germany | 416/224 |
| 697159 | 10/1940 | Fed. Rep. of Germany | 416/224 |
| 358206 | 7/1973 | Sweden . | |
| 360230 | 11/1931 | United Kingdom | 416/224 |
| 432386 | 7/1935 | United Kingdom . | |
| 656503 | 8/1951 | United Kingdom . | |

OTHER PUBLICATIONS

R. A. Wallis, "Dust Erosion of Fan Materials", Mechanical and Chemical Engineering Transactions, 1975, pp. 33–39.

C. A. Smeltzer et al., "Mechanisms of Metal Removal By Impact Dust Particles", Journal of Basic Engineering, Sep. 1970, pp. 639–654.

*Primary Examiner*—Everette A. Powell, Jr.

*Attorney, Agent, or Firm*—Sughrue, Mion, Zinn, Macpeak and Seas

[57] ABSTRACT

A considerable increase of the life time of metallic members, particularly the blades of fans or turbines, which are exposed to air-borne abrasive particles is obtained by providing such members with a wear-resisting attachment comprising at least two wear-resisting layers consisting of materials having complementary relationships of the erosion caused by said abrasive particles to the impact angle of the particles, said attachment being applied to surface portions of the members to be protected.

8 Claims, 8 Drawing Figures

PARTICLE EROSION RESISTANT COVERING FOR FAN BLADE LEADING EDGE

BACKGROUND OF THE INVENTION

The present invention relates to a wear-resisting attachment for protecting metallic members, particularly the blades of fans or turbines, against erosion caused by air-borne abrasive particles carried by a substantially linear air flow, to which such members are exposed.

By installation of axial flow fans in places, where considerable amounts of particles of abrasive materials are carried by the air volume conveyed by the fan, such as in the case of induced draught fans for coal-fired boilers in power stations, where the flow of flue gas passing the fan blades may have a great content of air-borne ash particles, the fan blades are exposed on the surface portion facing the air flow, i.e. particularly the leading edge, to a heavy wear in the form of erosion of the blade material.

This erosion is caused by the energy conversion taking place when ash particles impact on the blades and, at high loads, it may result in a very short lifetime for the blades.

In practice, it has been shown that the important parameters for the progress of the erosion beyond the characteristics of the blade material are the velocity, the impact angle, the hardness and the magnitude of the particles. In addition thereto, the progress of the erosion may in some cases be accelerated by chemical- or temperature-related influences. Thus, the presence of aggressive gases in the air-flow may at small energy conversions result in an accelerated wear which for some materials, such as rubber and plastics, may also arise at high temperatures.

It is known to provide fan blades for such applications where the blade material may be stainless steel with a wear-resisting attachment of a very hard material, such as hard chromium. In practice, however, local penetrative abrasions of such wear-resisting attachments have appeared to occur at, or symmetrically around the extremity of the leading edge of the blade, whereas the attachment outside these local penetrative abrasions may be relatively intact.

In practice, these problems have particularly been recognized for fan blades. However, it must be assumed that they will also apply to other metallic members, including particularly turbine blades which are exposed to a mainly linear air-flow carrying a considerable content of abrasive particles.

SUMMARY OF THE INVENTION

According to the invention, a considerably improved wear-resistance and thereby an increase of the lifetime is obtained by means of a wear-resisting attachment of the kind mentioned, which comprises at least two wear-resisting layers applied to surface portions of the member to be protected, which face said air-flow, said layers consisting of materials having complementary relationships of the erosion caused by said abrasive particles to the impact angle of the particles.

The invention is based on the recognition of the fact that of all the above mentioned parameters influencing the progress of the erosion, the impact angle of the particles has a particularly general and significant importance in that whereas the remaining parameters, such as the velocity, magnitude and form of the particles, are most frequently associated specifically with the particular installation or application, so that measures to reduce the erosion effect of these parameters must normally be determined for the particular installation on the basis of the knowledge of the composition of the air volume to be conveyed and the velocity thereof, the influence of the impact angle of the particles on the progress of the erosion is more closely elated to the characteristics of the wear-resisting attachment itself.

As already mentioned, the invention relates also to a blade for an axial flow fan conveying an air volume carrying air-borne abrasive particles, which is provided with such a wear-resisting attachment. According to the invention, such a fan blade comprises a wear-resisting attachment applied to the leading edge of the blade and including at least two wear-resisting layers consisting of materials having complementary relationships of the erosion caused by said abrasive particles to the impact angle of the particles.

BRIEF DESCRIPTION OF THE DRAWINGS

In the following, the invention will be explained in further details with reference to the accompanying schematical drawing, in which.

DETAILED DESCRIPTION

Figure 1:
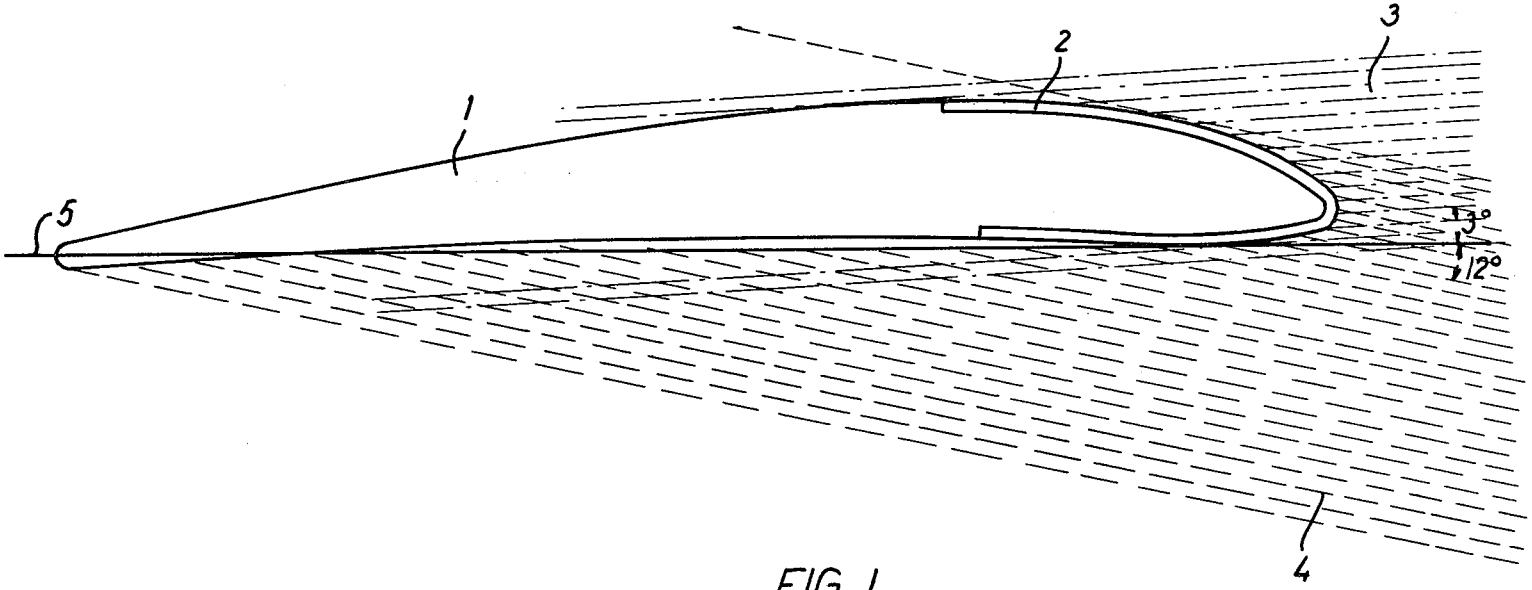
FIG. 1 shows a blade profile for an axial flow fan blade having a wear-resisting attachment at the leading edge.

FIG. 1 illustrates purely schematically how a blade 1 for an axial flow fan illustrated by the blade profile is striked by air-borne abrasive particles carried by the air volume conveyed by the fan at different fan loads or blade pitch adjustments.

Thus, the air-flow indicated by dot-and-dash lines 3 represent a minimum load, at which the chord of the bladae profile indicated by a line 5 forms a very small angle of about 3° with the main flow direction of the air-flow. The air-flow indicated by dashed lines 4 represents a case of maximum load, at which the chord 5 forms an angle of for example 12° with the main flow direction of the air-flow.

Figure 2:
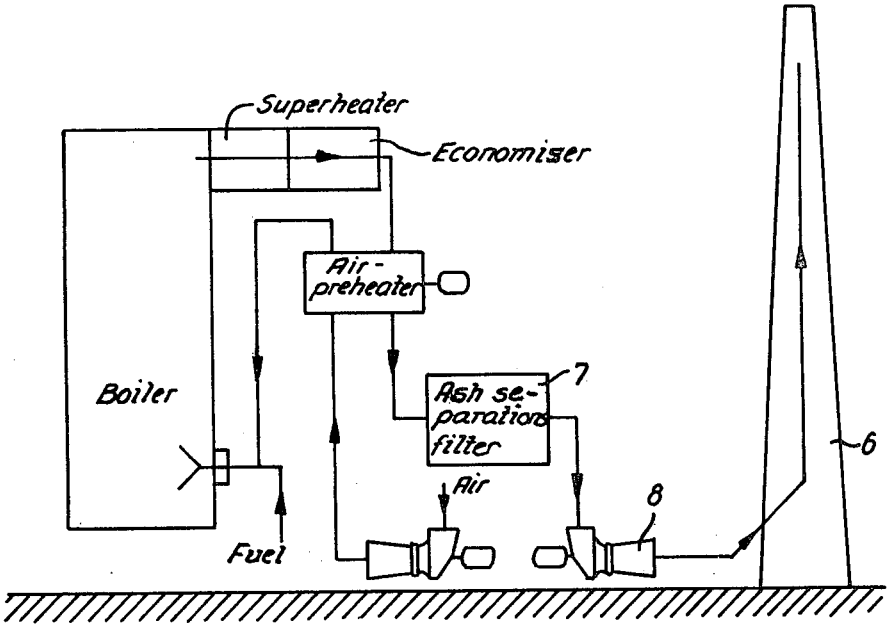
FIG. 2 illustrates the application of an axial flow fan as induced draught fan for a coal-fired boiler in a power station.

The illustrated exposure of the fan blades to abrasive particles occurs for example in induced draught fans for coal-fired boilers in power stations. FIG. 2 shows an example of such an installation, where the flow of flue gas conveyed by an axial flow fan 8 arranged between a chimney 6 and an ash separation filter 7 may have a considerable content of airborne ash particles, particularly in case of an insufficient ash separation, which particles strike the fan blades which are thereby exposed to a heavy wear in the form of erosion of the blade material on critical places around the leading edge of the blade.

This wearing action is, in principle, based on the energy conversion taking place at the impact of the abrasive ash particles against the fan blades, whereby a considerable portion of the kinetic energy at these particles is transferred to the blade material as deformation forces resulting in a gradual erosion of the blade material.

Investigations have shown that the wearing action is a complicated process, the progress of which depends, *inter alia,* on the following erosion parameters which, moreover, interact with each other:

(a) The impact velocity of the particles plays an important role for the rate of erosion expresssed by the portion of the blade material removed per time unit. Experiments have shown that the erosion rate E as a function of the impact velocity v may be expressed by $E \sim v\alpha$, in which, however, the power $\alpha$ depends on the magnitude of the particles and varies typically from about 2.0 for particles having a magnitude of 25 microns to about 2.3 for particles having a magnitude of 200 microns. The reason for this is to be seen in fractionation of greater particles impacting on the fan blades into smaller particles which may again srike the blades, so that both a primary and a secondary erosion will occur.

Furthermore, for the importance of the velocity, it is necessary to distinguish between the impact velocity as such and the relative velocity of the particles to the blade material before the moment of impact. Investigations have shown that smaller particles showing a greater tendency to follow the air-flow will give a somewhat smaller impact velocity than greater particles.

(b) The magnitude of the particles has also a considerable importance in that at a given velocity, no erosion will take place for particles below a certain magnitude as a result of the fact that the blade material is only exposed to elastic deformation from such small particles. In a following range of particle magnitudes, the blade material is exposed solely to primary erosion, whereas at increasing particle magnitude, fragmentation of the particles and, thereby, both primary and secondary erosion occur. For particle magnitudes above a certain upper limit, it has appeared that the erosion rate stabilizes at a saturation level which is positioned, however, considerably higher than the erosion rates applying to smaller particles which are not fragmented.

(c) The influence of the total particle content in the air-flow is normally such that proportionality between erosion rate and particle content will exist up to a certain limit, at which ariving particles and particles reflected from the blades begin to impact on each other.

(d) A further important factor is the hardness of the particles relative to the hardness of the blade material. Under equal conditions, it applies that erosion will increase considerably when the hardness of the particles exceeds the hardness of the blade material.

(e) The impact angle of the particles influences the progress of erosion considerably in dependence on the characteristics of the blade material around the critical places at the leading edge of the blade. As mentioned in the foregoing, it has appeared that for ductile materials, maximum erosion occurs for particle impact angles about 30°, whereas maximum erosion for hard and brittle materials occurs at impact angles about 90°.

Due to the interrelationship and mutual dependence of the erosion parameters mentioned in the foregoing, it is not possible to predict the progress of erosion by considering these parameters individually. However, as a conclusion, it applies that the magnitude of the particles has a considerable importance, since, on one hand, greater particles due to secondary erosion will lead to a higher rate of erosion and, on the other hand, smaller particles will give a smaller impact velocity for the same relative velocity before impact.

As mentioned, also the ratio of particle hardness to hardness of the blade material is considerably important. In view thereof, it is known to counteract the erosion by arranging a wear-resisting attachment around the critical places at the leading edge of the blade, such as shown at 2 in FIG. 1. Such a wear-resisting attachment consists of a thin plate of a hard material, in most cases an alloy of hard chromium and stainless steel 18/8, said plate being formed to follow the blade profile accurately and being bolted or screwed to a cut-out formed for this purpose at the leading edge of the blade, which is normally made of aluminium, in order to facilitate replacement.

Figure 3:
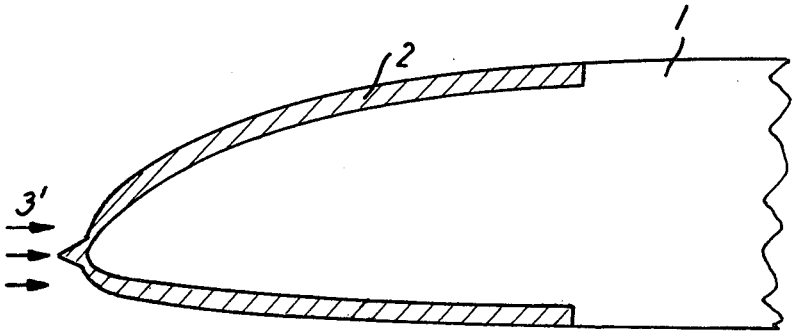
FIG. 3 illustrates local penetrative abrasion of a wear-resisting attachment of a known material.

However, it has appeared that when loading the fan blades with abrasive particles, such a wear-resisting attachment will gradually have an appearance as illustrated in FIG. 3 with pronounced local penetrative abrasion of the wear-resisting attachment 2 at discrete locations at the leading edge of the blade, whereas the remaining part of the attachment will be substantially intact.

The appearance of a wear-resisting attachment illustrated in FIG. 3 has been observed by practical experiments with an axial flow fan arranged in a flow of flue gas, the flow direction of which, as illustrated by arrows 3' formed an angle of 0.6° with the chord direction of the blade profiles and having a content of air-borne ash particles showing the following characteristics:

| Distribution of particle magnitudes | |
|---|---|
| 0–5μm | 27% |
| 5–10μm | 13% |
| 10–100μm | 38% |
| above 100μm | 22% |

| Chemical composition | 0–40μm | 44–125μm | above 125 μm |
|---|---|---|---|
| $SiO_2$ | 52% | 51% | 47% |
| $Al_2O_3$ | 22.5% | 21.5% | 19.5% |
| $Fe_2O_3$ | 13.2% | 15.3% | 11.4% |
| CaO | 2.2% | 2.2% | 2.0% |
| MgO | 1.1% | 1.1% | 1.0% |
| S | | | 0.3% |

| Hardness (Vickers) |
|---|
| 400–1500 HV |

According to the invention, a considerably improved wear-resistance is obtained by means of a wear-resisting attachment comprising two superimposed wear-resisting layers consisting of materials having complementary relationships of the erosion caused by the abrasive particles to the impact angle of the particles.

Figure 4:
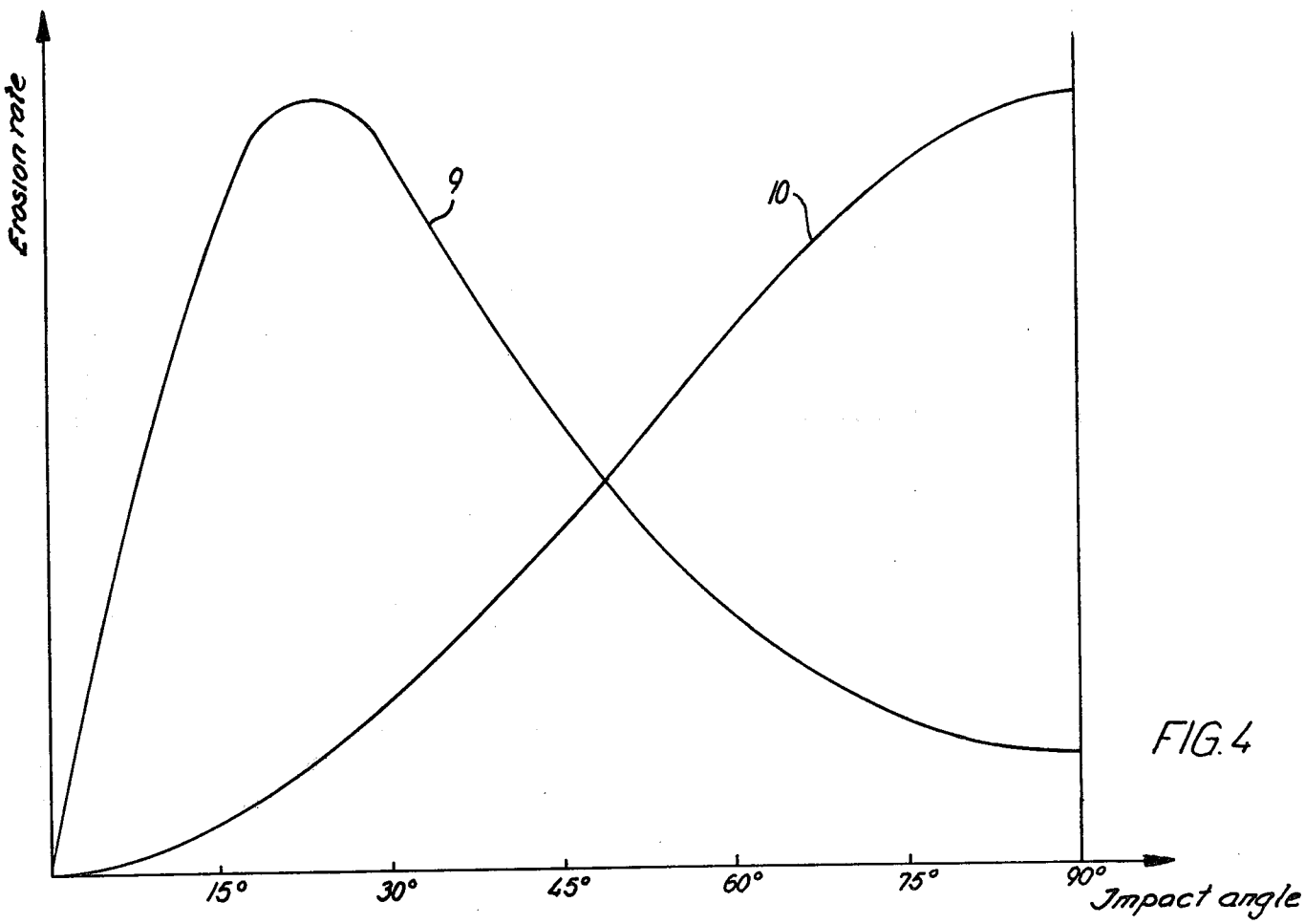
FIG. 4 is a graphic representation of erosion sensitivity as a function of particle impact angle for complementary wear-resisting materials in a wear-resisting attachment according to the invention.

Thus, a preferred wear-resisting attachment according to the invention consists of two wear-resisting layers, one of which is made of a relatively ductile material, the maximum erosion sensitivity of which occurs at particle impact angles in the range from 15° to 30°, such as illustrated by the curve 9 in FIG. 4, whereas this material is relatively resistant to erosion for particle impact angles in the range from 45° to 90°, while the other material is a relatively hard and brittle material, the maximum erosion sensitivity of which occurs for particle impact angles in the range from 75°–90°, such as illustrated by the curve 10, said material being relatively resistant to erosion for particle impact angles in the range from 0° to 45°.

In a preferred embodiment, the wear-resisting attachment according to the invention is formed in the same manner as illustrated by the attachment 2 in FIG. 1 as a wearing nose detachably secured in a cut-out around the leading edge of the blade, said wearing nose comprising the wear-resisting layers according to the invention in superimposed relationship. The above mentioned conditions in respect of the relationship of erosion sensitivity to particle impact angle will be fulfilled for example by Stellite Haynes Alloy No. 25 as the ductile material constituting one wear-resisting layer, and hard chromium as the hard and brittle material constituting the other wear-resisting layer. In this context, the term "hard chromium" is to be understood as a relatively thick chromium layer of 0.5 to 1.0 mms. The wearing nose may be constructed from a bent plate of Haynes Alloy No. 25, the outer side of which is plated with said hard chromium layer.

Figure 5:
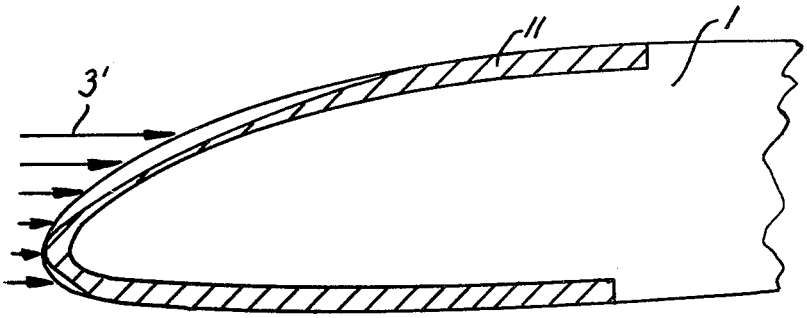
FIG. 5 illustrates local penetrative abrasion of a wear-resisting attachment consisting of one of the materials illustrated in FIG. 4.

In order to illustrate the effect of a wear-resisting attachment consisting of a combination of the above mentioned material, FIG. 5 shows how a wear-resisting attachment consisting solely of Stellite Haynes Alloy No. 25 will look after being exposed to a wearing action of the same extent as illustrated in FIG. 3.

Figure 6:
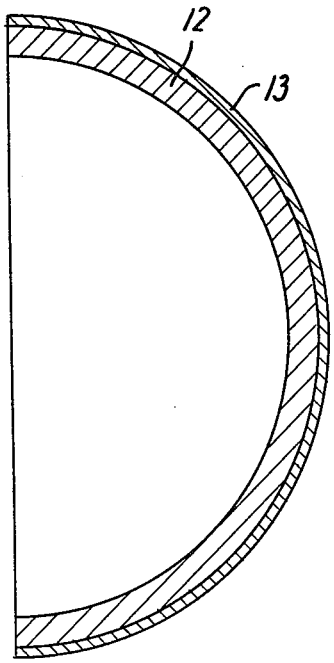
FIG. 6 illustrates the principal construction of a wear-resisting attachment according to the invention.

In FIG. 6, a combined two-layer wear resisting attachment is schematically illustrated for a semi-circular profile corresponding substantially to the leading edge of a fan blade. In order to maintain a suitable form of the blade profile, the layer 12 closest to the blade material should preferably be the layer of the ductile material such as Stellite Haynes Alloy No. 25, since this layer will normally have a greater thickness than the overlying layer 13 of a hard and brittle material such as hard chromium.

Figure 7:
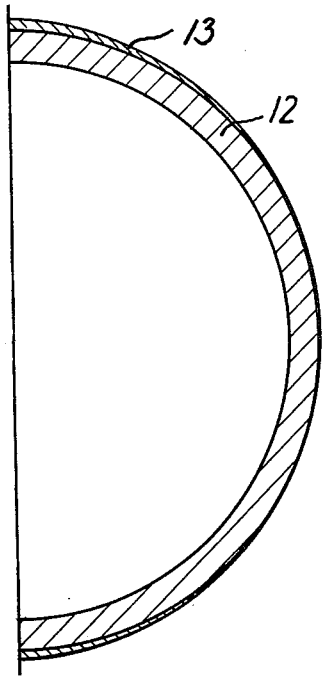
FIGS. 7 and 8 illustrate the wear-resisting attachment shown in FIG. 6 in two different states of erosion.
Figure 8:
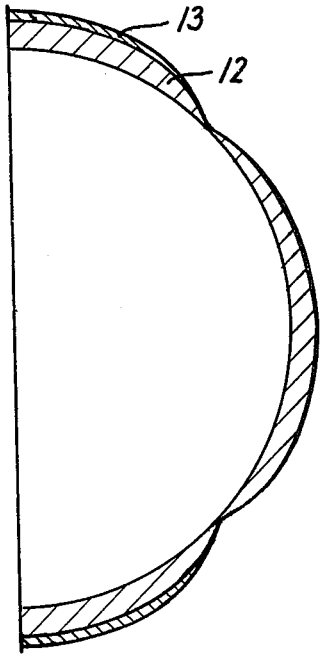

The progress of erosion for a profile having such a wear-resisting attachment is illustrated in FIG. 7 under the same conditions, i.e. after exposure to the same extent of wearing action as illustrated in FIGS. 3 and 5, and it appears therefrom that the wear-resisting attachment consisting of layers 12 and 13 considered as a whole is still intact. The local penetrative abrasion of the wear-resisting attachment illustrated in FIG. 8 will not occur until after exposure to a considerably increased wearing action, or a considerably extended time of operation under the same conditions as in FIGS. 3, 5 and 7. The investigations which have been made indicate that the resistance to wear has been substantially doubled relative to the known wear-resisting attachment illustrated in FIG. 3.

In order to offer a good protection of the blade, the wear-resisting attachment should preferably be arranged on surface portions of the blade at the leading edge thereof, for which outwardly projecting normal vectors form angles between 90° and 180° with the main flow direction of the air-flow.

For the range of angular relationships between the main flow direction and the chord direction of the blade profile extending from the rear edge to the leading edge of the blade illustrated in FIG. 1, this means that the wear-resisting attachment should extend from the leading edge of the blade on the upper side of the blade to a point, in which the outwardly projecting normal vector forms an angle of about 93° with said chord direction, and a similar extension should apply to the underside of the blade.

Although only a wear-resisting attachment for a fan blade has been described in the foregoing as an embodiment of the invention, the invention is not limited to this application, but may also be utilized in case of other metallic members which are exposed to mainly linear air-flows carrying air-borne abrasive particles. As exmaples of such other applications, reference could be made particularly to turbine blades and rotor blades for helicopters, which during start and landing are often exposed to air-blasts containing heavily abrasive sand particles.

What I claim is:

1. A wear-resisting attachment for application to a surface portion of a metallic member, particularly a blade of a fan or a turbine, for protecting said surface portion against erosion from abrasive particles carried by a substantially linear air flow, to which said surface portion is exposed, said abrasive particles striking different parts of said surface portion under varying impact angles, comprising: at least two superimposed wear-resisting layers, one of said layers being relatively ductile and providing an erosion sensitivity versus particle impact angle characteristic which is complementary to that of at least one other, relatively brittle layer over a range of impact angles extending from 0 degrees to 90 degrees, said one layer having a maximum erosion sensitivity in a first, smaller angle portion of said range in which said at least one other layer is relatively resistant to erosion, and said one layer being relatively resistant to erosion in a second, larger angle portion of said range in which said at least one other layer has a maximum erosion sensitivity.

2. A wear-resisting attachment as claimed in claim 1, wherein said one layer has a maximum erosion sensitivity for particle impact angles between 15° and 30° and is relatively resistant to erosion for particle impact angles between 45° and 90°, whereas said other layer has a maximum erosion sensitivity for particle impact angles between 75° and 90° and is relatively resistant to erosion for particle impact angles between 0° and 45°.

3. A wear-resisting attachment as claimed in claim 1, wherein said one layer consists of Stellite Haynes alloy No. 25 and said other layer consists of hard chromium.

4. A blade for an axial flow fan comprising a surface portion exposed to a substantially linear air flow carrying abrasive particles striking different parts of said surface portion under varying impact angles and a wear-resisting attachment applied to said surface portion, said wear-resisting attachment comprising at least two superimposed wear-resisting layers, one of said layers being relatively ductile and providing an erosion sensitivity versus particle impact angle characteristic which is complementary to that of at least one other, relatively brittle layer over a range of impact angles extending from 0 degrees to 90 degrees, said one layer having a maximum erosion sensitivity in a first, smaller angle portion of said range in which said at least one other layer is relatively resistant to erosion, and said one layer being relatively resistant to erosion in a second, larger angle portion of said range in which said at least one other layer has a maximum erosion sensitivity.

5. A fan blade as claimed in claim 4, wherein said surface portion comprises a region around the leading edge of the blade and adjoining portions of both blade sides, for which outwardly projecting vectors normal to the blade surface at any point form an angle between 90° and 180° with the chord direction of the blade profile extending from the leading edge to the rear edge of the blade.

6. A fan blade as claimed in claim 4, wherein said one layer has a maximum erosion sensitivity for particle impact angles between 15° and 30° and is relatively resistant to erosion for particle impact angles between 45° and 90°, whereas said other layer has a maximum erosion sensitivity for particle impact angles between 75° and 90° and is relatively resistant to erosion for particle impact angles between 0° and 45°.

7. A fan blade as claimed in claim 6, wherein said one layer consists of Stellite Haynes alloy No. 25, and said other layer consists of hard chromium.

8. A fan blade as claimed in claim 5, wherein said wear-resisting attachment constitutes a wearing nose to be detachably connected with said region.

* * * * *